US011426619B1

(12) United States Patent
Shane

(10) Patent No.: US 11,426,619 B1
(45) Date of Patent: Aug. 30, 2022

(54) EXERCISE RACK

(71) Applicant: Astone Fitness Ltd., Richmond (CA)

(72) Inventor: Darren Shane, Richmond (CA)

(73) Assignee: Astone Fitness Ltd., Richmond (CA)

( * ) Notice: Subject to any disclaimer, the term of this patent is extended or adjusted under 35 U.S.C. 154(b) by 0 days.

(21) Appl. No.: 17/204,824

(22) Filed: Mar. 17, 2021

(51) Int. Cl.
*A63B 21/078* (2006.01)

(52) U.S. Cl.
CPC ..... *A63B 21/078* (2013.01)

(58) Field of Classification Search
CPC ..... A63B 23/1218; A63B 17/04; A63B 21/00047; A63B 21/068; A63B 21/4035; A63B 23/0352; A63B 1/00; A63B 21/00061; A63B 21/0442; A63B 21/0552; A63B 23/0205; A63B 23/03541; A63B 23/1227; A63B 23/1236; A63B 71/023; A63B 2208/0285; A63B 2208/029; A63B 2209/02; A63B 2210/52; A63B 2225/09; A63B 2225/093; A63B 9/00; A63B 3/00
See application file for complete search history.

(56) References Cited

U.S. PATENT DOCUMENTS 3,384,332 A * 5/1968 Fenner ..... A63B 7/00 248/165
3,944,219 A * 3/1976 LoPresti ..... A63B 21/1645 482/38
4,846,205 A * 7/1989 Knoll ..... E04H 15/003 403/291
4,921,245 A * 5/1990 Roberts ..... A63B 7/02 482/42
5,290,209 A * 3/1994 Wilkinson ..... A63B 21/00047 482/141
D358,623 S * 5/1995 Macasieb ..... A63B 21/169 D21/691
7,364,530 B2 4/2008 Lopez
8,079,915 B2 * 12/2011 Spencer ..... A63G 9/00 472/118
9,267,769 B1 * 2/2016 Gempler ..... B25H 1/06
9,675,829 B1 * 6/2017 Katz ..... A63B 17/02
10,207,142 B2 * 2/2019 Le Nguyen ..... A63B 23/1227
D844,078 S * 3/2019 Salomone ..... D21/691
10,220,252 B2 * 3/2019 Jackson ..... A63B 21/4035
D852,907 S * 7/2019 Sergakis ..... D21/686
(Continued)

*Primary Examiner* — Andrew S Lo
*Assistant Examiner* — Andrew M Kobylarz
(74) *Attorney, Agent, or Firm* — Oyen Wiggs Green & Mutala LLP

(57) ABSTRACT

An exercise apparatus configurable in a collapsed configuration and an expanded configuration is provided. The exercise apparatus includes: a horizontal upper support structure comprising a pair of vertical sleeves at opposing ends of the upper support structure; first and second inserts receivable in a corresponding one of the vertical sleeves; and first and second leg assemblies coupled to a corresponding one of the first and second inserts. A bottom contact surface of each of the first and second inserts angles upwardly laterally outward, and wherein a top contact surface of each of the first and second leg assemblies is level, whereby when the exercise apparatus is in the expanded position respective top contact surfaces of the first and second leg assemblies abut corresponding bottom contact surfaces of the first and second inserts, whereby the first and second leg assemblies splay laterally outward.

18 Claims, 18 Drawing Sheets

(56) References Cited

U.S. PATENT DOCUMENTS

| | | | | |
|---|---|---|---|---|
| D875,266 | S * | 2/2020 | Qiu | D24/213 |
| D883,406 | S * | 5/2020 | Sergakis | D21/686 |
| 11,045,687 | B1 * | 6/2021 | Salomone | A63B 23/1218 |
| D928,253 | S * | 8/2021 | Dunahay | D21/686 |
| 2005/0003938 | A1 * | 1/2005 | Henderson | A63B 21/4035 482/142 |
| 2005/0130806 | A1 * | 6/2005 | Lopez | A63B 21/00047 482/38 |
| 2012/0085380 | A1 * | 4/2012 | Buckley | E04H 15/46 135/140 |
| 2012/0142506 | A1 * | 6/2012 | Hetrick | A63B 21/00047 482/142 |
| 2012/0329613 | A1 * | 12/2012 | Schiano | A63B 21/078 29/428 |
| 2013/0237394 | A1 * | 9/2013 | Fowler | A63B 21/00047 482/142 |
| 2015/0196119 | A1 * | 7/2015 | Henniger | A63B 1/00 211/85.7 |
| 2020/0139181 | A1 * | 5/2020 | Thomas | A63B 21/00047 |
| 2022/0054880 | A1 * | 2/2022 | Bielawski | A63B 21/078 |

* cited by examiner

EXERCISE RACK

FIELD OF INVENTION

This present invention relates to the field of portable exercise devices, generally to improve health, fitness, and increase physical activity, and more particularly, but not by way of limitation, to a transformable, lightweight, portable and stable exercise apparatus for use in performing a wide variety of exercises and activities including but not limited to various strength, conditioning, martial arts, aerial, dance, suspended swinging activities, or stretching exercises.

BACKGROUND OF THE INVENTION

With the development of the modern society, stressful and busy lifestyles are normal. With new emerging global pandemics, this creates challenges and new constraints of available space and sites for doing exercise and physical activity with lockdowns and facility closures. Insufficient amounts of exercise are common, which eventually affects the mental and physical health and strength of human beings. Various exercise apparatus are available in the market to allow a user to do exercise at home, in a commercial gym and for outdoor training. These apparatus allow a user to exercise and remain physically active, targeting muscles, joints, and improving cardiovascular health with the use of various strength training equipment and devices, thereby eventually improving the health of the user.

Physical activity and exercise are commonly achieved by engaging in resistance training, floor and aerial dance movements, mat and suspended yoga postures, playground activities, cardiopulmonary exercise training, and other movement and strength activities using exercise racks, workout machines, portable devices and bodyweight activities. Resistance exercise training is a form of physical activity that is designed to improve muscular fitness and strength by exercising a muscle or muscle group against external resistance. The external resistance can be your own body weight, exercise tubing, free weights including barbells, or any other object that causes the muscles to contract. Aerial dance and yoga provide a gravity-based exercise method using straps, slings, and other suspended support where the user suspends their body and performs a variety of movement and stretching patterns building strength and flexibility. Playground activities including monkey bars for chin-ups and swing sets can be used by all ages as a way to keep active and fit creating a fun exercise method. Cardiopulmonary training exercise is intended to strengthen the circulatory system by improving the endurance and functional capacities of the body's cardiovascular and pulmonary systems. The American College of Sports Medicine minimum guidelines for strength and endurance exercises include at least 150 minutes of moderate-intensity cardiopulmonary exercise per week (30 minutes 5 days per week) and resistance exercise training (two to three days per week) of each major muscle group.

There are products available on the market that can provide users with exercise equipment for multiple modes of fitness training. Such available equipment can often be heavy in weight, provide limited exercise variations per apparatus, be unstable by design, are difficult to move, require multiple users to set-up and take down, involve many separate parts and tools to set-up and dissemble and are not normally suited for home installation or smaller fitness facilities due to the equipment being very space consuming. As a result, sufficient total body training can be inaccessible to many people as it requires users to visit a fitness training facility, such as a gym or private training studio or to visit a large outdoor park with a stable playground to play on a swing set, pull-up bars and monkey bars to perform strength and physical activity exercises.

There is a need to provide a portable, multi-function exercise apparatus that is more convenient and easier to set-up and take-down.

Conventional portable fitness devices often include resistance bands, cables, elastic ropes, and other accessory attachments that may be attached to different sized frames and designed to be secured and used on a sturdy door. These devices often can only be used by a single user at one time.

Conventional exercise racks and physical activity devices are typically large in design, heavy in overall weight, require many parts and tools for assembly, are unable to adjust in height, require 2-5 people to set-up and the user must store all the parts separately when disassembled. Examples of conventional workout rack devices are: The Octagon Frame™ by Escape Fitness, the Queenax Functional Stations™ by Precor, the Monster Wingspan Rig™ by Rogue, and the CrossCore Multi-Purpose Rack™ by Mad Dogg Athletics. Disadvantages of conventional exercise racks and physical activity workout station devices are the inability to quickly assemble and disassemble, the lack of portability, unstable design causing lateral instability due to the vertical leg set-up and the required large space needed for use and storage of all the separate components.

Heretofore, with most conventional exercise racks and physical activity devices, the length of the legs is fabricated at a predetermined set height limiting the set-up inside a space with a low ceiling clearance. Conventional exercise rack devices are often large in design and often the legs are vertically set-up causing lateral stabilization imbalances and limiting the safety and stability of the apparatus during exercise and physical activity movements.

In conventional exercise racks and physical activity devices, portability is an issue due to the time involved in setting up and taking down the apparatus, and users choose to not take down the device as they are unable to quickly and easily disassemble. Storage is another issue due to the size and weight of all the separate components.

A variety of collapsible, portable and freestanding exercise devices have been developed for physical activity and exercise training. But problems exist with these physical activity and exercise devices including: they take up large exercise floor space areas; they often takes much time and multiple people for set-up and to disassemble; they are complex in construction requiring many separate parts and tools; they lack overall stability in design; they are difficult to transport due to the size and weight; and they require much space for storage of all the separate parts.

These exercise devices claim to be quickly collapsible and portable, however, the user must carefully take time aligning all the frame and component parts, accurately placing and being careful not to strip bolts, screws and locking devices into specified holes, and to remember to reverse the set-up procedure without misplacing parts for storage and transporting.

Exercise apparatus that addresses one or more of the foregoing problems is desirable.

SUMMARY OF THE INVENTION

Maintaining a daily or consistent regimen of exercise and physical activity is extremely important to the health of human beings. Having access to a commercial gym, apartment fitness center, local community centre, and other health, fitness and physical activity locations can easily be disrupted and user access compromised with pandemics, temporary and permanent facility closures, forced lock-downs, curfews and not having enough space in one's home to achieve total body workouts with conventional exercise equipment.

In today's highly mobile and busy society, having the ability to quickly and easily set-up and disassemble a user's personal exercising device for use in one's home, office or transporting to maintain an exercise regimen during a vacation or a trip is very useful to maintaining one's health and fitness.

The present invention generally provides an exercise apparatus that enables users to perform a large number of exercises and physical activity movements by the use of the user's bodyweight, in optional conjunction with accessories removably attached to various locations along said apparatus.

Aspects of the present invention includes a portable, stable and lightweight main framework which can be transformed into a compact and inter-connected device for easy set-up and collapsing by one user without the need for tools and storage of separate parts. Disadvantages of conventional portable exercise apparatus include the inability or difficulty in disassembling and transporting the device when a user must be away from their home or office where the exercise device is typically used; as a consequence the exercising regimen is interrupted or broken. Additional disadvantages are complexity of design requiring many parts and tools for assembly, these exercise devices are typically large in design, heavy in overall weight, have limited use and function, lack overall stability in design causing safety concerns, are unable to adjust in height, require 2-5 people to set-up, and the user must store all the parts separately when disassembled requiring a large storage area.

Aspects of the present invention comprise a lightweight, stable, portable exercise apparatus that allows users to quickly and easily set-up and disassemble to transport so that the chosen exercising and physical activity regimen may be continued at all times both at home, office, vacation or a trip. This is accomplished by a compact, transformable exercise apparatus that can be readily assembled, disassembled, and transported in a convenient rolling carrying case. The manner by which this invention achieves the goals hereof will become apparent in the description which follow, particularly when read in conjunction with the accompanying drawings.

Aspects of the present invention comprise a portable and transformable exercise apparatus that includes an interconnected main framework comprising a horizontal upper support structure connected to leg assemblies by angled inserts that provide for outward splay of the leg assemblies. In some embodiments the leg assemblies are pivotally coupleable to the inserts to allow compact folding of the leg assemblies below the horizontal upper support structure. These and other features solve the above-identified problems of conventional exercise rack and physical activity workout station devices by providing a lightweight, height adjustable, stable, portable, fully transformable, compact, easily set-up and disassembled device by a single user. The device also allows a user to easily vary the height of the device and to quickly set-up and collapse with a limited storage requirement. Thus, a user can travel with the device and easily set-up in different locations that may not have a great deal of available space.

In accordance with aspects of the invention, the exercise apparatus can arrange multiple mechanisms and conventional training aids such as martial arts heavy bags, suspension straps, aerial dance rings, aerial yoga slings, squat arms with use of a barbell, bar press attachments, swing set accessories, etc. The exercise apparatus may therefore be used by one or more individuals to accommodate multiple users performing personalized training routines together, saving space, and can be placed indoors or outdoors.

The exercise apparatus is configured such that its components such as the horizontal upper support structure, inserts, joint hinge brackets, telescoping stabilization legs, upper support structure stabilization strut arms, locking leg brackets, angular joint hinge brackets, and retractable locking feet are interconnected and joined to each other in a manner that apparatus stability is maintained to provide for a sturdy exercise apparatus adapted and designed to endure various loads, multi-directional movements and a variety of exercise postures and training modalities.

It is another aspect of the present invention to provide a stable anchoring device to anchor and attach portable fitness accessories including resistance bands, rotational pulleys, abdominal straps, triceps ropes and other fitness accessories.

It is another aspect of the present invention to provide a stable anchoring device to attach a swing set seat and a pair of attachment strap members to the top horizontal upper support structure for users of all ages to sit on and swing and play.

Another aspect of the present invention is to provide a stable anchoring device for suspendible exercise straps to perform total body exercise movements.

Another aspect of the present invention is to provide heavy-duty anchor pins with rubber stoppers for storing weight plates to the bottom of the angular telescopic stabilization legs, which also act to add additional weight to the device for greater balance and stability.

Another aspect of the present invention is to provide an exercise device that a user can perform barbell squats with weight plates using the attachment member squat arms accessory.

It is another aspect of the present invention to provide an exercise device that a user can attach one or more bar attachment presses attached to a foot plate attachment accessory to perform total body exercise strength movements.

It is another aspect of the present invention to provide a stable anchoring device for aerial dance rings and aerial yoga slings to perform suspended dance and yoga movements.

It is yet another aspect of the present invention to provide a stable anchoring device for a heavy bag for use with punching and kicking and other forms of combat and martial arts training.

It is yet another aspect of the present invention to provide a stable anchoring device to perform pullups and chin-ups using the top support structures rounded tubular grip bar.

It is another aspect of the present invention to transform into a compact portable free-standing exercise rack and physical activity workout device for use indoors and outdoors.

It is another aspect of the present invention that such engagement and set-up may be through the use of pins, through clamping means and generally through a variety of conventional locking and engagement means.

It is another aspect of the present invention to have a transformable, collapsible, and portable design for the compact main framework and the angular telescopic support legs to be able to manually open and close by only one person.

It is yet another aspect of the present invention for the legs to angularly splay out from the top horizontal upper support structure and to connect the upper support structure stabilization strut arms to the angular telescopic stabilization legs so as to maximize the forward and lateral stability of the exercise apparatus.

It is yet another aspect of the present invention that it has interconnected components to further enhance the ease of set-up and disassembly with limited storage space required.

It is another aspect of the present invention to have an H-shaped leg locking transport fixture to secure and lock the legs when lifting and moving.

It is another aspect of the present invention to have a protective carry bag with rolling wheels to secure the device into for easy transport.

The unique design of the portable, transformable, free-standing exercise apparatus allows the main framework of the top horizontal upper support structure, angular telescopic stabilization legs, upper support structure stabilization strut arms, locking leg brackets, angular joint hinge brackets and retractable locking support feet to be manually opened and closed into a compact inter-connected device that can be completely assembled and disassembled with only one person.

In another aspect of the present invention, an exercise apparatus configurable in a collapsed configuration and an expanded configuration is provided. The exercise apparatus includes: a horizontal upper support structure comprising a pair of vertical sleeves at opposing ends of the upper support structure; first and second inserts receivable in a corresponding one of the vertical sleeves; and first and second leg assemblies coupled to a corresponding one of the first and second inserts. A bottom contact surface of each of the first and second inserts angles upwardly laterally outward, and wherein a top contact surface of each of the first and second leg assemblies is level, whereby when the exercise apparatus is in the expanded position respective top contact surfaces of the first and second leg assemblies abut corresponding bottom contact surfaces of the first and second inserts, whereby the first and second leg assemblies splay laterally outward.

The bottom ends of the first and second inserts may angle upwardly laterally outward at about 2.5 to 7.5 degrees, or about 5 degrees, from the horizontal.

Each of the first and second inserts may be engageable with a corresponding vertical sleeve at a retracted position, and at least the second insert is telescopically engageable with the corresponding vertical sleeve between the retracted position and an extended position.

Each of the first and second leg assemblies may be pivotally coupleable to respective first and second inserts for pivotal adjustment between respective folded positions when the exercise apparatus is in the collapsed configuration and respective unfolded positions when the exercise apparatus is in the expanded configuration.

In the collapsed configuration the first insert may be engaged with the corresponding vertical sleeve at the retracted position, and the second insert is engaged with the corresponding vertical sleeve at the extended position, whereby the first leg assembly in the folded position is folded between the horizontal upper support structure and the second leg assembly in the folded position.

The vertical sleeves and the first and second inserts may comprise corresponding locking means for releasably lockingly engaging the first and second inserts within the vertical sleeves in the retracted position, and releasably lockingly engaging the second insert in the extended position.

The locking means may comprise a throughhole in each vertical sleeve, corresponding retracted position throughholes in the first and second inserts, and a corresponding extended position throughhole in the second insert, wherein the throughholes of the vertical sleeves and the first and second inserts are alignable to receive locking pins.

The first and second leg assemblies may each comprise a joint hinge bracket for pivotally coupling to the first and second inserts, the joint hinge brackets each comprising a top bracket element and a bottom bracket element connected back-to-back and offset by 90 degrees.

The top bracket element may comprise inner througholes and outer throughholes, each corresponding to inner throughholes and outer throughholes adjacent the bottom contact surfaces of the first and second inserts, wherein the first and second leg assemblies are pivotable when the inner throughholes of the top bracket element and first and second inserts are aligned and receive locking pins, but are not pivotable when the outer throughholes of the top bracket element and first and second inserts are aligned and receive locking pins or when both the inner and outer throughholes of the top bracket element and first and second inserts are aligned and receive locking pins.

An inner edge of the bottom contact surface of the first and second inserts may be rounded equidistantly from the inner throughhole of the first and second inserts to facilitate pivotal motion of the first and second leg assemblies.

The first and second leg assemblies may each comprise a pair of telescoping stabilization legs, wherein the bottom bracket element is fixedly connected to the telescoping stabilization legs.

Each pair of the telescoping stabilization legs may comprise a foldable leg spread linking mechanism for reversibly locking the telescoping stabilization legs in a spread manner.

Each pair of the telescoping stabilization legs may comprise a retractable locking leg bracket.

Each pair of the telescoping stabilization legs may comprise a retractable foot.

A bottom surface of the retractable foot may angle upwardly laterally inward in correspondence to the laterally outward splay of the first and second leg assemblies.

The bottom surface of the retractable foot may angle upwardly laterally inward about 7.5 to 12.5 degrees, or about 10 degrees, from the horizontal.

The exercise apparatus may include a foot plate attachment onto which the retractable foot is secured.

The exercise apparatus may include a bar press attachment assembly comprising: a U-joint bracket fixed to the foot plate attachment; a U-joint block pivotally coupled to the U-joint bracket; and a bar press sleeve pivotally coupled to the U-joint block.

The exercise apparatus may include a pair of articulated squat arms releasably lockingly coupled to the one of each pair of the telescoping stabilization legs.

One of each pair of the telescoping stabilization legs may comprise a throughhole at a lower portion thereof for receiving a pin for receiving weight plates for storage and stability of the exercise apparatus.

The above features, advantages, and still further objects of the present invention together with the various ancillary provisions which become apparent to those skilled in the art from the following detailed description, are attained by the exercise apparatus of the present invention, preferred embodiments thereof being shown with reference to the accompanying written description, claims, and appended drawings.

BRIEF DESCRIPTION OF DRAWINGS

These and other features, aspects and advantages of this disclosure will now be described in connection with some embodiments of the present disclosure, in reference to the accompanying drawings. The illustrated embodiments, however, are merely examples and are not intended to limit the present disclosure. Other objects of the present invention will become apparent from the description and the drawings of the present invention, in which.

It is to be noted, however, that the appended figures illustrate only typical embodiments of the disclosed assemblies, and therefore, are not to be considered limiting in their scope, for the disclosed assemblies may admit to other equally effective embodiments that will be appreciated by those reasonably skilled in the relevant arts. Also, figures are not necessarily made to scale.

DETAILED DESCRIPTION

The terms "inner" and "inward" as used herein refers to a position, orientation or direction toward an imaginary vertical center line of the exercise apparatus as viewed from the front. The terms "outer" and "outward" as used herein refers to a position, orientation or direction away from the imaginary vertical center line center of the exercise apparatus as viewed from the front.

Embodiments of the invention provide an exercise apparatus configurable between a collapsed configuration and an expanded configuration. The exercise apparatus includes a horizontal upper support structure with vertical sleeves for receiving inserts. Angled bottom surfaces of the insert provide angled contact with the leg assemblies resulting in a desirable outward splay of the leg assemblies for stability in the expanded configuration. In some embodiments the inserts may pivotally couple with leg assemblies, whereby differential telescopic engagement of the inserts with the horizontal upper support structure provides compact folding of the leg assemblies resulting in desirable portability of the exercise apparatus in the collapsed configuration.

Multiple features of an embodiment will now be illustrated with reference to FIGS. 1-12, which show the stabilizing outward splay of the leg assemblies in the expanded configuration and the transformable and compact folding of the collapsed configuration.

Figure 1:
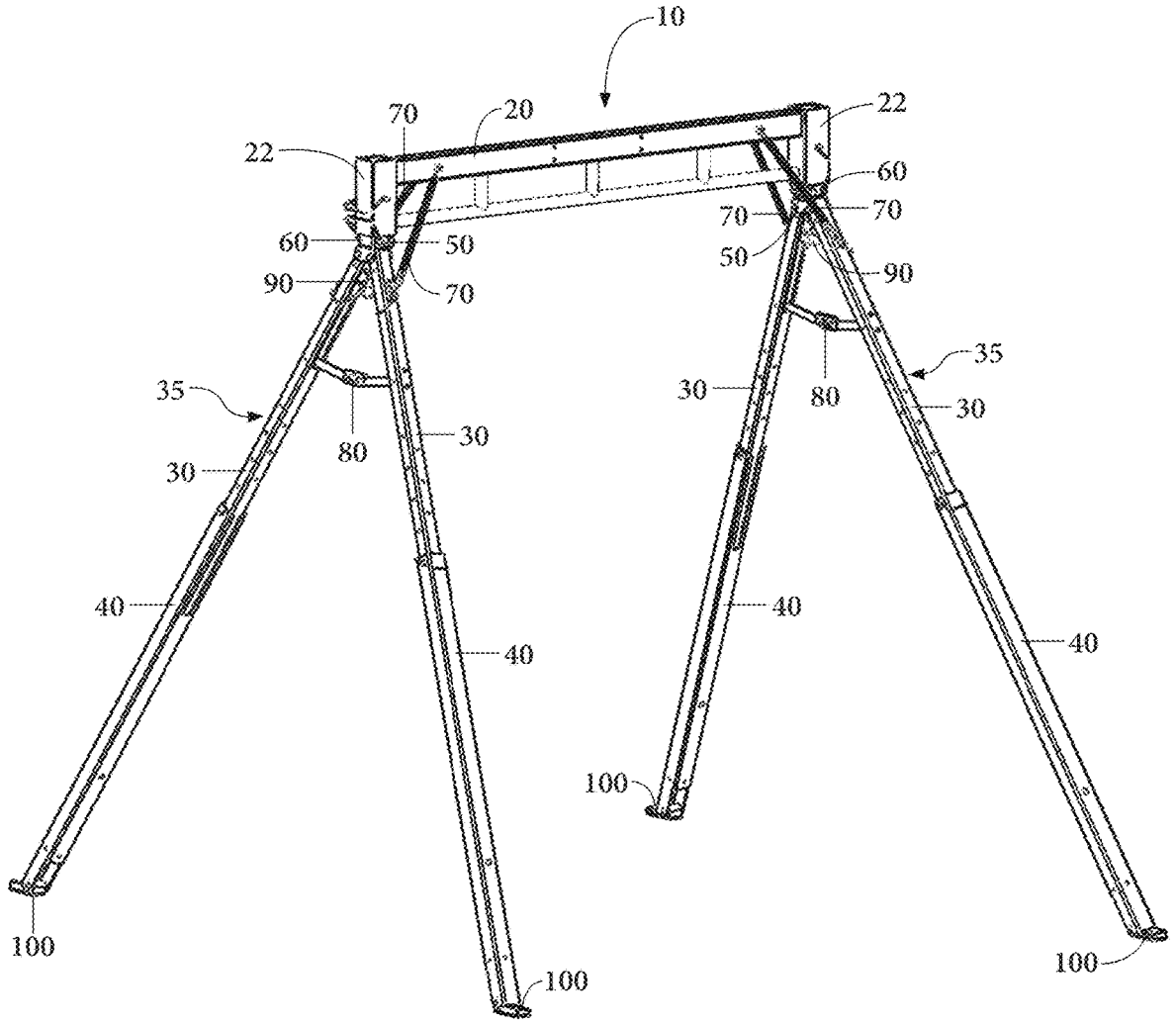
FIG. 1 is a perspective view of the expanded configuration of an embodiment of the present invention.
Figure 2:
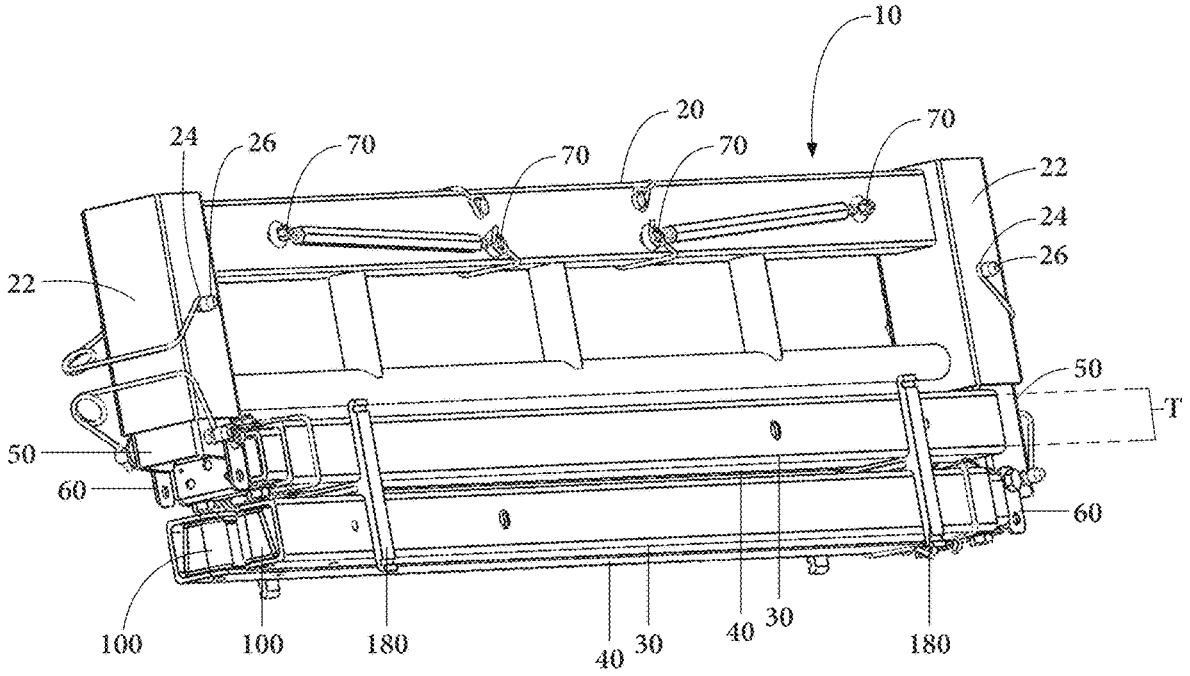
FIG. 2 is a perspective view of the collapsed configuration of the embodiment shown in FIG. 1.
Figure 3:
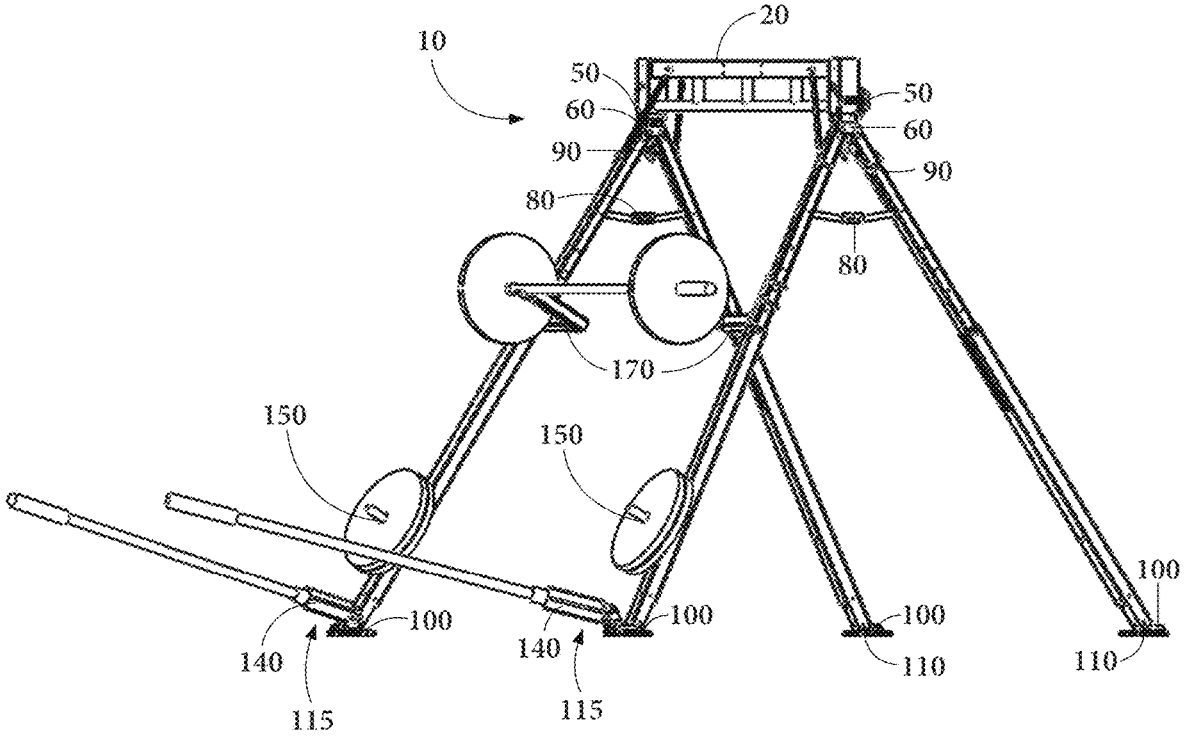
FIG. 3 is a perspective side view of the embodiment shown in FIG. 1, additionally showing squat arms, bar press attachments and weight plate pin accessory attachment members with suitable mounting mechanisms.

Reference is first being made to FIG. 1 showing a perspective view of an exercise apparatus, generally designated by the numerical 10 according to an exemplary embodiment of the present invention. The exercise apparatus 10 in FIG. 1 is in the expanded configuration and is set up to enable a wide variety of total body strength training and for multiple forms of physical activity to be performed as part of a regular exercise and movement regimen. The exercise apparatus 10 is adapted to enable users to exercise using body weight and to attach accessory attachment members with suitable mounting mechanisms for physical activity and strength training for the use of more than 1 user at one time. FIG. 2 is a perspective illustration of exercise apparatus 10 in the collapsed configuration, that is, folded and transformable into a compact, portable and fully interconnected unit.

Exercise apparatus 10 includes a horizontal upper support structure 20 with a pair of vertical sleeves 22 at its opposite ends. Telescopically engageable within sleeves 22 are vertically oriented inserts 50. Inserts 50 are coupled to leg assemblies 35.

Leg assemblies 35 include joint hinge bracket 60, telescopic stabilization legs 40, 30, strut arms 70, leg spreading link mechanisms 80, locking leg brackets 90, and retractable feet 100. Joint hinge bracket 60 is fixedly coupled to telescopic stabilization legs 40, 30. Leg spreading link mechanisms 80 and locking leg brackets 90 expand and lock to provide stability, and retract and fold into into channels of telescopic stabilization legs 40, 30 as telescopic stabilization legs 40, 30 themselves are brought together for folding. In some embodiments leg spreading link mechanisms 80 and/or locking leg brackets 90 may be absent. In some embodiments feet 100 may be non-retractable.

Figure 6:
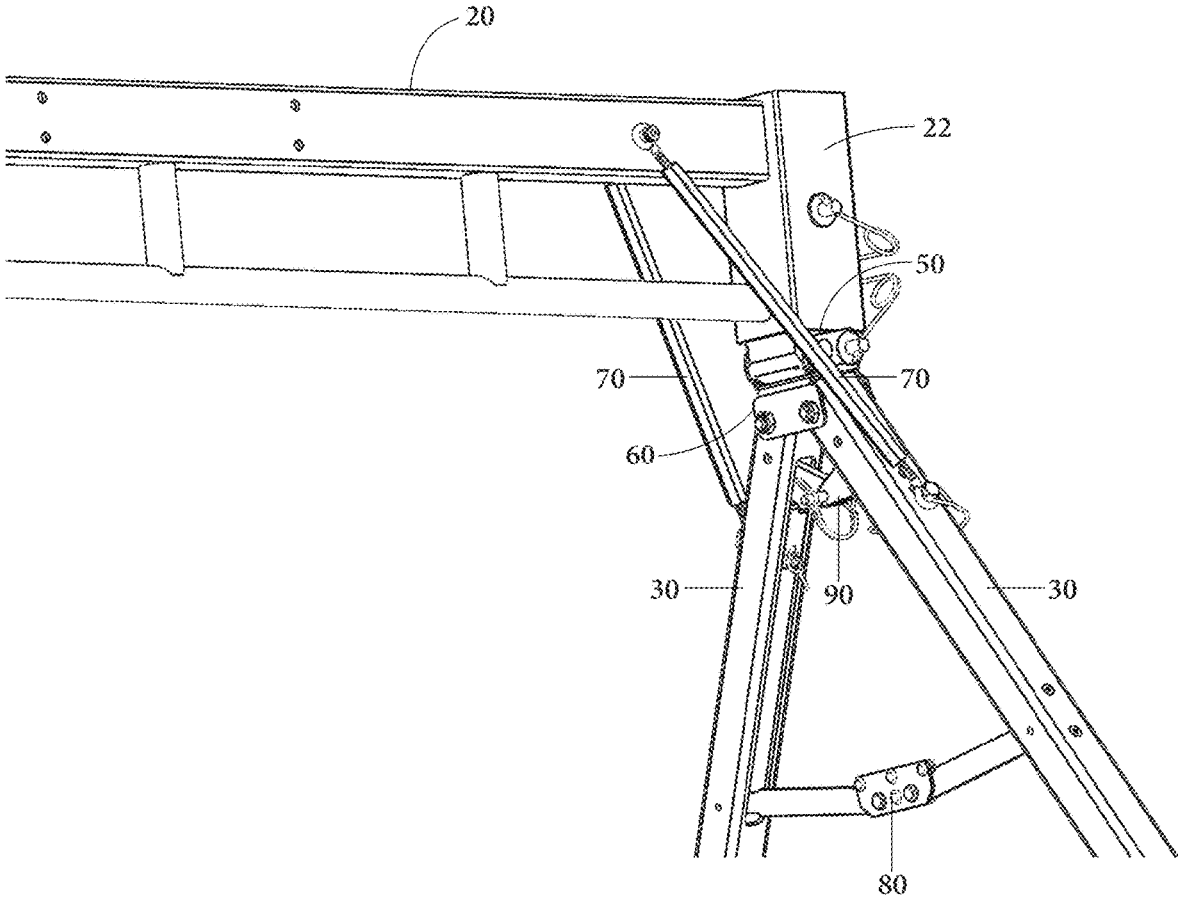
FIG. 6 is a close up partial perspective outward facing view of the embodiment shown in FIG. 1 showing the connection between the horizontal upper support structure, the insert, and the leg assembly.
Figure 7:
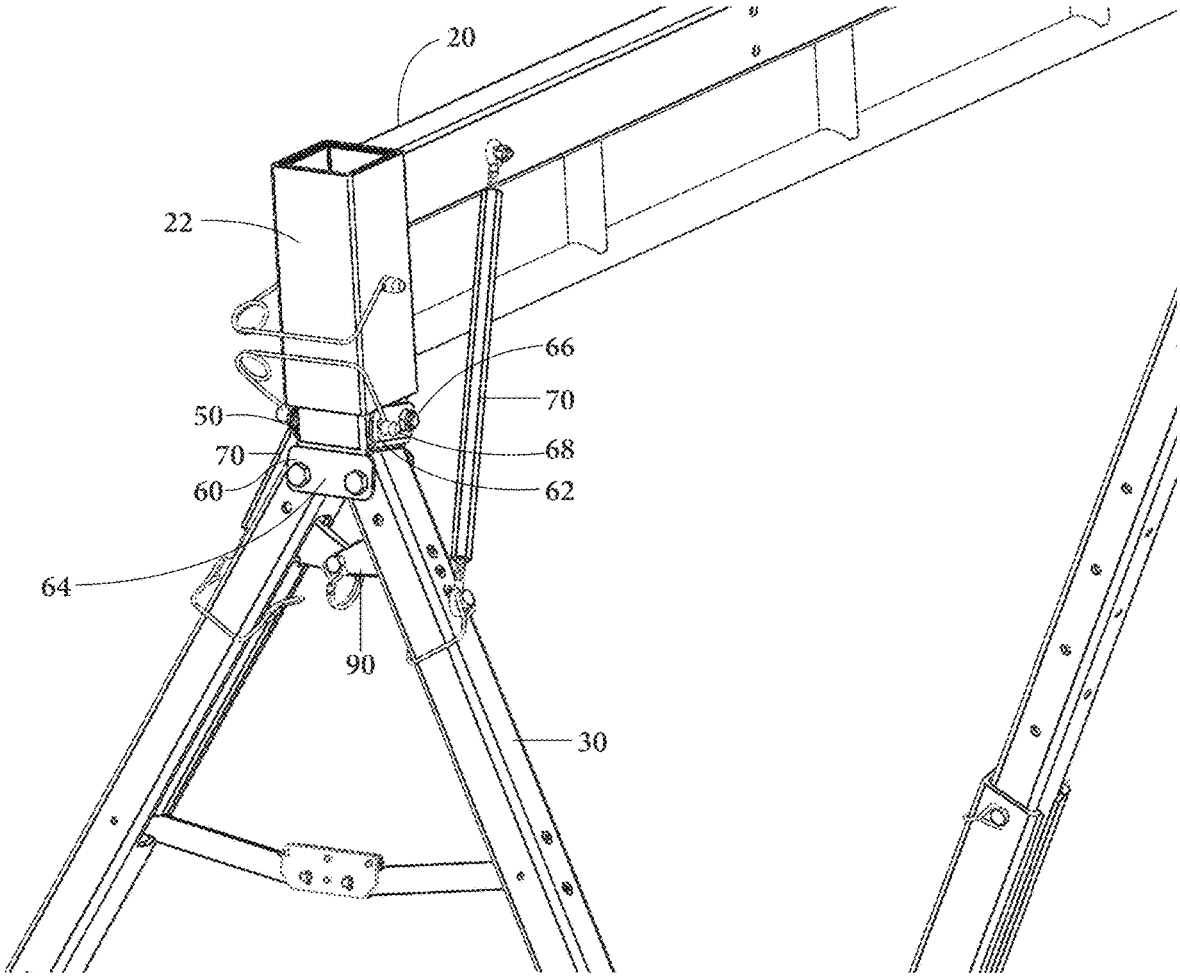
FIG. 7 is a close up partial perspective inward facing view of the embodiment shown in FIG. 1 showing the interconnection between the horizontal upper support structure, the insert, and the leg assembly.
Figure 8:
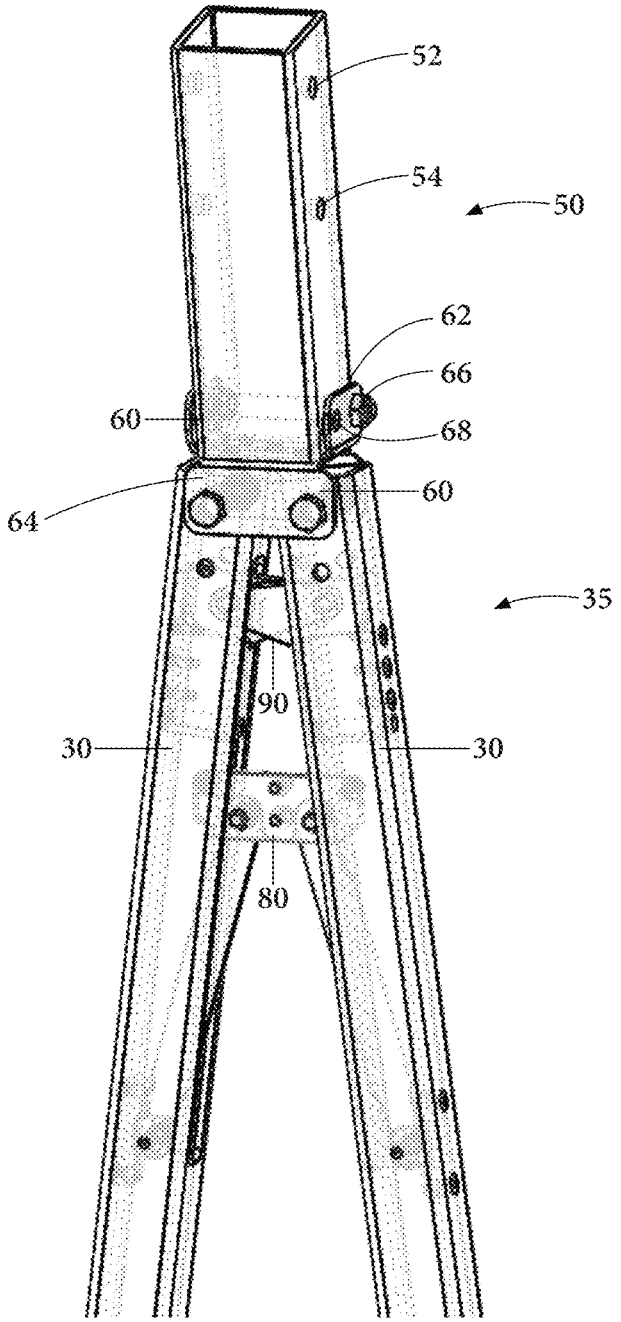
FIG. 8 is a close up partial perspective inward facing view of the embodiment shown in FIG. 1 showing the interconnection between the insert and the leg assembly, with the leg assembly in a partially collapsed configuration.
Figure 8A:
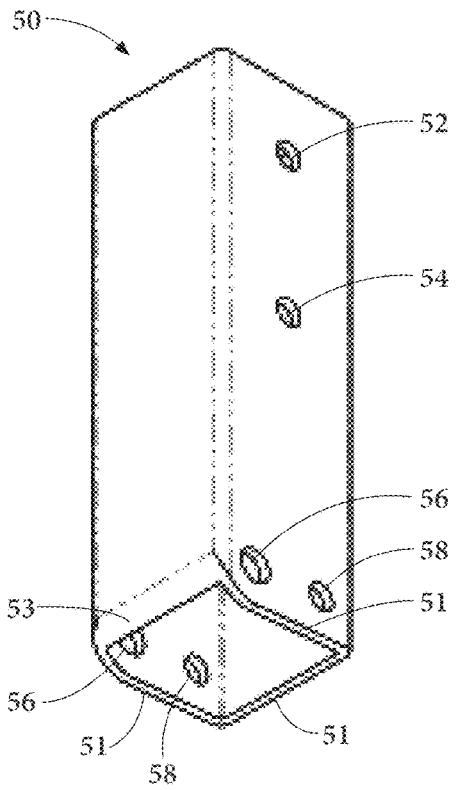
FIG. 8A is a perspective view of the insert of the embodiment shown in FIG. 1 in isolation.
Figure 8B:
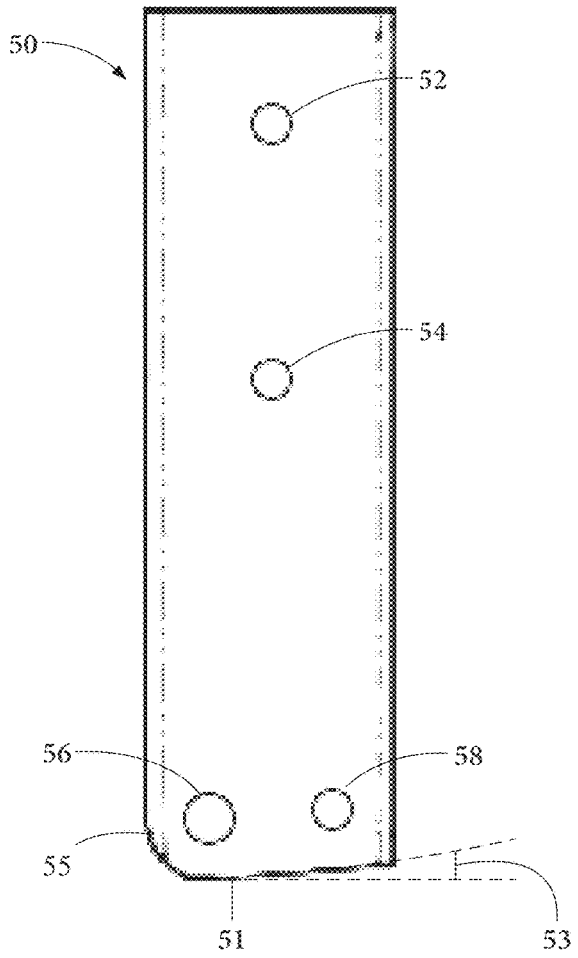
FIG. 8B is a front view of the insert shown in FIG. 8A.
Figure 8C:
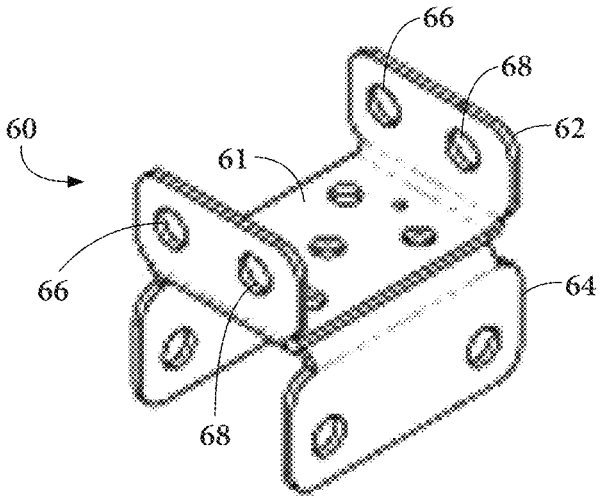
FIG. 8C is a perspective view of the joint hinge bracket of the embodiment shown in FIG. 1 in isolation.
Figure 8D:
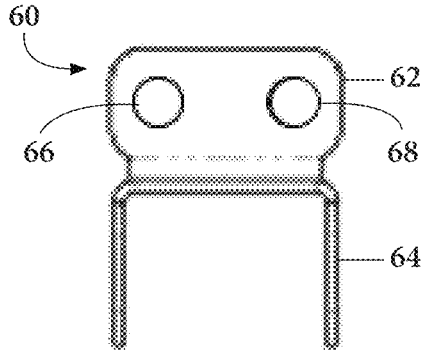
FIG. 8D is a front view of the joint hinge bracket shown in FIG. 8C.
Figure 8E:
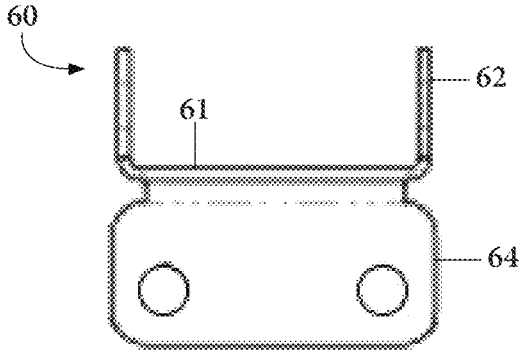
FIG. 8E is a side view of the joint hinge bracket shown in FIG. 8C.
Figure 8F:
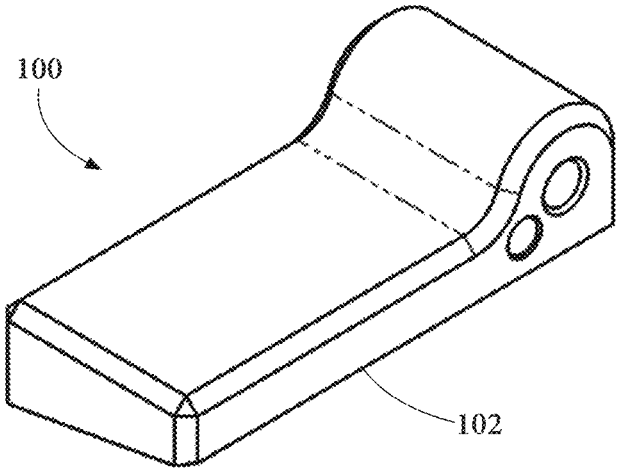
FIG. 8F is a perspective view of a retractable foot of the embodiment shown in FIG. 1 in isolation.

Joint hinge bracket 60 consists of a top bracket element 62 connected back-to-back to a bottom bracket element 64, where elements 62 and 64 are offset by 90 degrees, as best shown in FIG. 8C to 8E. In some embodiments top bracket element 62 and bottom bracket element 64 may be welded or otherwise joined together. In some embodiments top bracket element 62 and bottom bracket element 64 may be an integral piece with their respective vertically extending portions still offset by 90 degrees. Top bracket element 62 has inner throughholes 66 and outer throughholes 68 that align with corresponding inner throughholes 56 and outer throughholes 58 of insert 50. In the expanded configuration of exercise apparatus 10, locking pins are secured in inner throughholes 56, 66 and outer throughholes 58, 68 as shown in FIGS. 6 and 7 to securely connect leg assemblies 35 to inserts 50. In the collapsed configuration of exercise apparatus 10, the locking pin for outer throughholes 58, 68 is removed, leaving only a pivotal coupling with the locking pin in inner throughholes 56, 66, as shown in FIG. 8, to allow for inward pivotal folding of leg assemblies 35.

Figure 5:
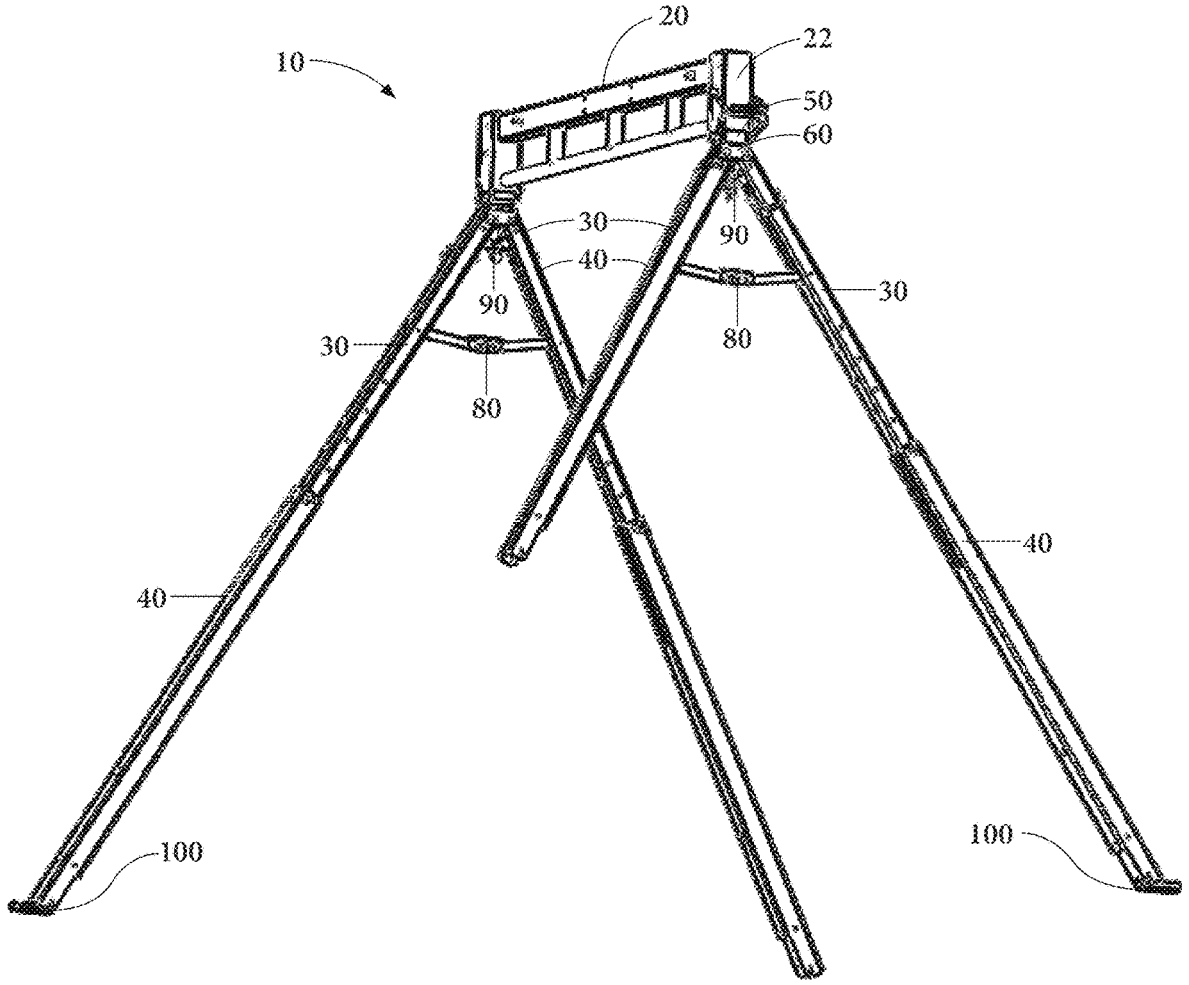
FIG. 5 is a perspective view of the embodiment shown in FIG. 1, with a telescoping stabilization leg retracted.

Telescopic stabilization legs 40, 30 can be telescopically shortened in length by sliding the telescopic stabilization legs 40 upward into the telescopic stabilization legs 30 and securing in a retracted position with a conventional locking mechanism as shown in FIG. 5. In some embodiments stabilization legs 40, 30 may be non-telescoping.

Horizontal upper support structure 20 may include a horizontal round tube, horizontal rectangular tube and vertical round tubes with contoured sections being inter-connected into a single rigidly welded member. The outer most end portions of the upper horizontal support structure 20 are vertical sleeves 22, for example round corner square tubing on opposite ends, for telescopic engagement with insert 50. In some embodiments horizontal upper support structure 20 may simply be a single horizontal tube with vertical sleeves 22 at each outer end.

Sleeves 22 each have throughholes 24. Both inserts 50 engage sleeves 22 at a retracted position. In the illustrated embodiment, the retracted position refers to alignment of throughhole 24 of sleeve 22 with lower throughhole 54 of insert 50 and securing with locking pin 26. In other embodiments, the retracted position may for example refer to the abutment of the top of insert 50 against an upper end of sleeve 22. At least one insert 50 includes an upper throughole 52 for locking pin engagement with throughhole 24 of sleeve 22 to define an extended position. The difference between the telescoping distance of insert 50 in sleeve 22 between the retracted position and extended position is greater than the thickness T of folded and retracted telescoping stabilization legs 30, 40, to allow for spaced folding of retracted stabilization legs 30, 40 to achieve the collapsed configuration of exercise apparatus 10.

In particular, as shown in FIG. 2 the left insert 50 is in the retracted position and the right insert 50 is in the extended position, allowing for the left leg assembly 35 to fold directly under horizontal upper support structure 20, and the right leg assembly 35 to folder under left leg assembly 35. In some embodiments, the left insert may be configurable in the extended position, such that the right leg assembly folds directly under the horizontal upper support structure. In some embodiments, such as the illustrated embodiment, both the left and right insert may be configurable in the extended position, such that either leg assembly may fold directly under the horizontal upper support structure.

Exercise apparatus 10 in the collapsed configuration may be further secured together with an H-shaped leg locking transport fixture 180 to secure and lock leg assemblies 35 when lifting and moving.

FIGS. 8A and 8B show an insert 50 in isolation. Insert 50 has an inner bottom edge 55 that is rounded equidistantly about inner throughhole 56 to facilitate pivotal motion of leg assemblies 35.

Figure 4:
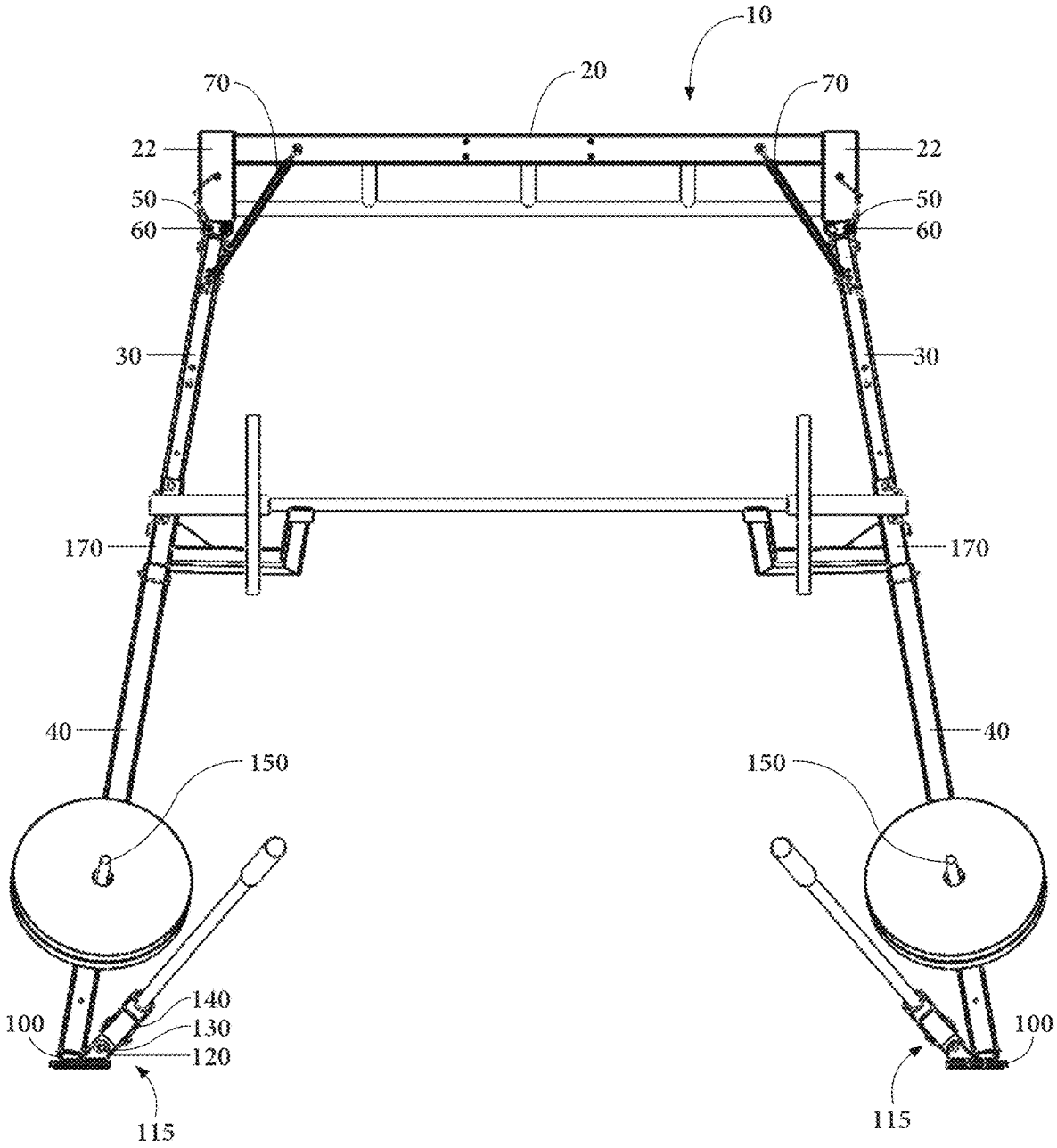
FIG. 4 is a is a perspective front view of the embodiment shown in FIG. 1, additionally showing squat arms, bar press attachments and weight plate pin accessory attachment members with suitable mounting mechanisms.

Insert 50 also has a bottom contact surface 51 that angles upward laterally outward at an angle 53 from the horizontal. Angle 53 may be about 2.5 degrees to 7.5 degrees, or about 5 degrees. Inner throughhole 56 and outer throughhole 58 are vertically offset by a corresponding amount to account for this angling of bottom contact surface 51, that is, the distance from the center of inner throughhole 56 to bottom contact surface 51 and the distance from the center of outer throughhole 58 to bottom contact surface 51 are the same. When exercise apparatus 10 is in the expanded configuration as shown for example in FIG. 7, bottom contact surface 51 fully contacts level top contact surface 61 of joint hinge bracket 60 at the top of leg assemblies 35, and the corresponding throughholes of top bracket element 62 and insert 50 are aligned and locked as previously described herein. The term "level" means that top contact surface 61 is perpendicular to the vertical extent of leg assemblies 35. The resulting angling of leg assemblies 35 achieves the laterally outward splay of leg assemblies as best shown in FIG. 4 to enhance lateral stability of exercise apparatus 10.

To provide additional stability to exercise apparatus 10, upper support structure stabilizing strut arms 70 inter-connect to horizontal upper support structure 20 and interconnect to telescopic stabilization legs 40, 30 through predetermined holes using a conventional locking mechanism to secure to exercise apparatus 10. Upper support structure stabilizing strut arms 70 have threaded screw channel ends thereby firmly fastening and tightening to exercise apparatus 10 creating stabilization support.

A leg spread linking assembly 80 inter-connects and is inserted into predetermined cut-out slots on telescopic stabilization leg 30, 40 to support the spreading of telescopic stabilization leg 30, 40 and to provide additional stability. Leg spread linking assembly 80 can lock into a horizontal orientation when telescopic stabilization leg 40, 30 are extended and set-up. As telescopic stabilization legs 40, 30 are telescopically shortened and folded together as shown in FIG. 2, leg spread link assembly 80 can retract and slide up and into predetermined cut-outs on both telescopic stabilization legs 40, 30.

A locking leg brackets 90 inter-connects at an upper end of telescopic stabilization leg 30 and lock using a locking mechanism to prevent the legs from spreading side to side when fully extended and set-up as shown in FIG. 7. When exercise apparatus 10 is being collapsed, locking leg brackets 90 can retract up into predetermined cut-outs in telescopic stabilization leg 30 as exercise apparatus 10 is configured in the collapsed configuration shown in FIG. 2.

Retractable feet 100 are disposed at lower ends of telescopic stabilization leg 40. Retractable feet 100 are foldable in into predetermined cut-outs of lower ends of telescopic stabilization leg 40. Round corner telescopic square tubing with a pair of parallel transverse through holes centered on each leg 40 may connect with round shape top locking mechanism holes such as pins on retractable feet 100, being inter-connected with a spring like locking mechanism and pressed pin plungers. As shown in FIG. 8H, bottom surface 102 of retractable feet 100 may be angled upwardly laterally inward at angle 104 from the horizontal to align with the angle of telescopic stabilization legs 40, 30, in correspondence with the laterally outward splay of leg assemblies 35, to create a flat and stable base for stability for exercise apparatus 10. Angle 104 may be about 7.5 to 12.5 degrees, or about 10 degrees.

Figure 8G:
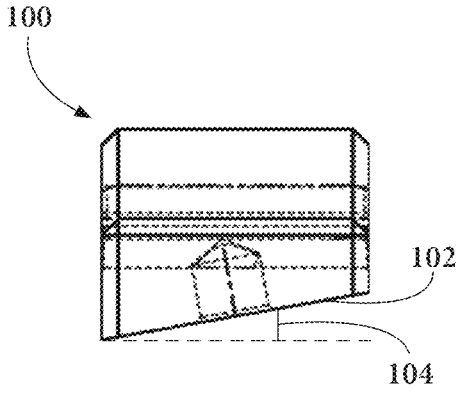
FIG. 8G is a front view of the retractable foot shown in FIG. 8F.
Figure 9:
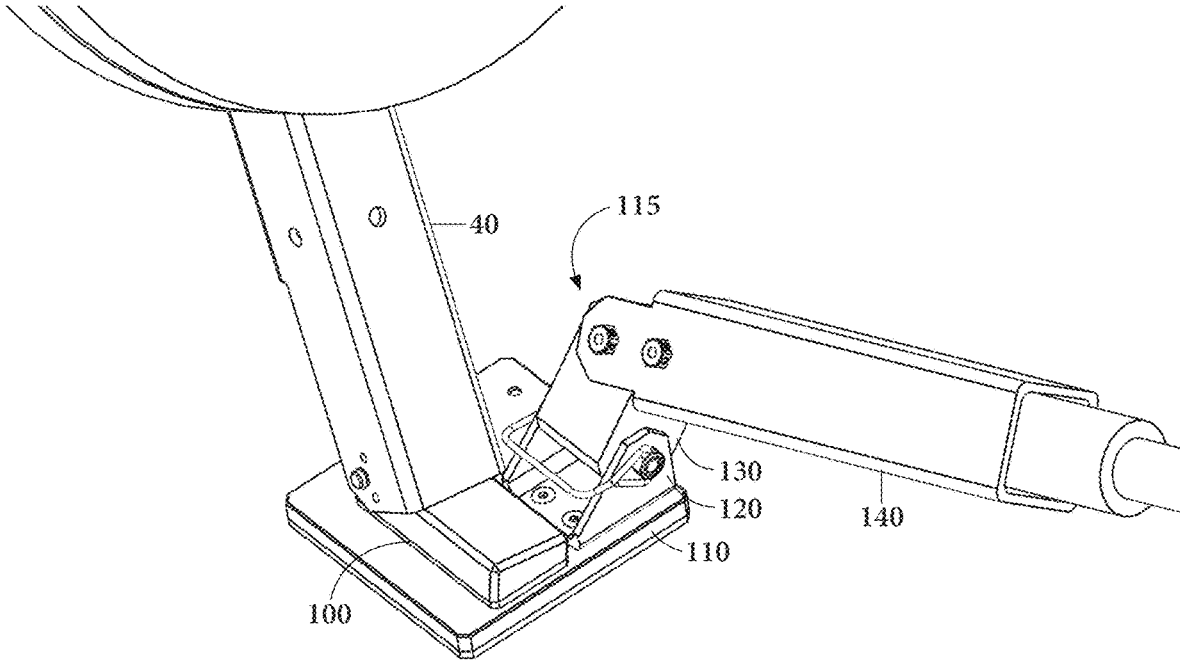
FIG. 9 is a close up partial perspective front view of the embodiment shown in FIG. 3 showing the connection between the retractable foot, the bar press attachment and the foot plate.

As shown in FIG. 9, retractable feet 100 connect to a foot plate attachment 110 to provide a larger base of support for additional stability as shown in FIG. 9. Bottom surface 102 of retractable feet 100 may provided with one or more holes for receiving correspondingly shaped projections extending vertically from foot plate 110 (see FIG. 8G, and in with respect to foot 201, FIGS. 13D and 13E). Foot plate attachment 110 may connect to a bar press attachment assembly 115 for holding a barbell bar to perform strength and core training exercises. Bar press attachment assembly 115 includes a U-joint bracket 120, connected to U-joint block 130, connected to bar press sleeve 140 providing 360° degree rotational and strength training orientation and function.

Figure 10:
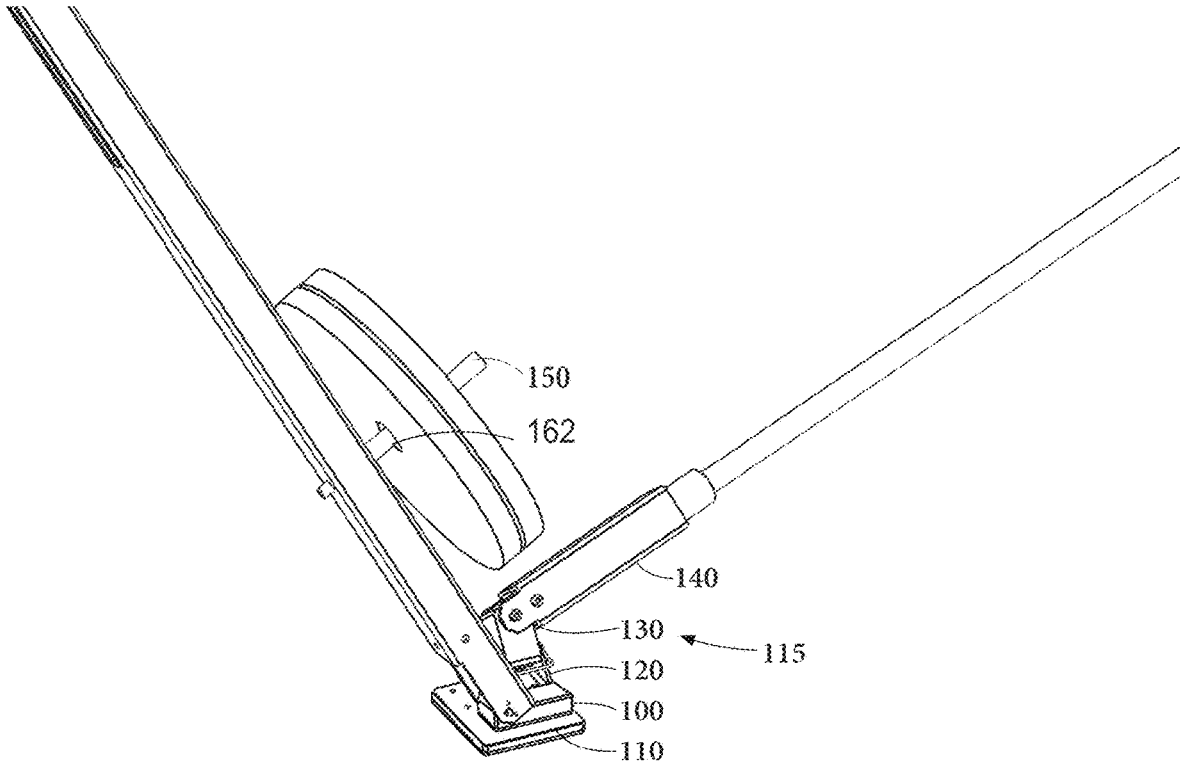
FIG. 10 is a close up partial perspective front view of the embodiment shown in FIG. 3 showing the connection between the retractable foot, the bar press attachment and the foot plate, and the connection between the telescoping stabilization leg, the heavy-duty anchor pin and rubber stopper for holding weight plates.

As shown in FIG. 10, heavy-duty anchor pin 150 inserts and connects rigidly through a pre-set hole on telescopic stabilization leg 40 with rubber protective stopper 162 placed at the end of heavy-duty pin 150 to place weight plates for storage and additional stability for exercise apparatus 10.

Figure 11:
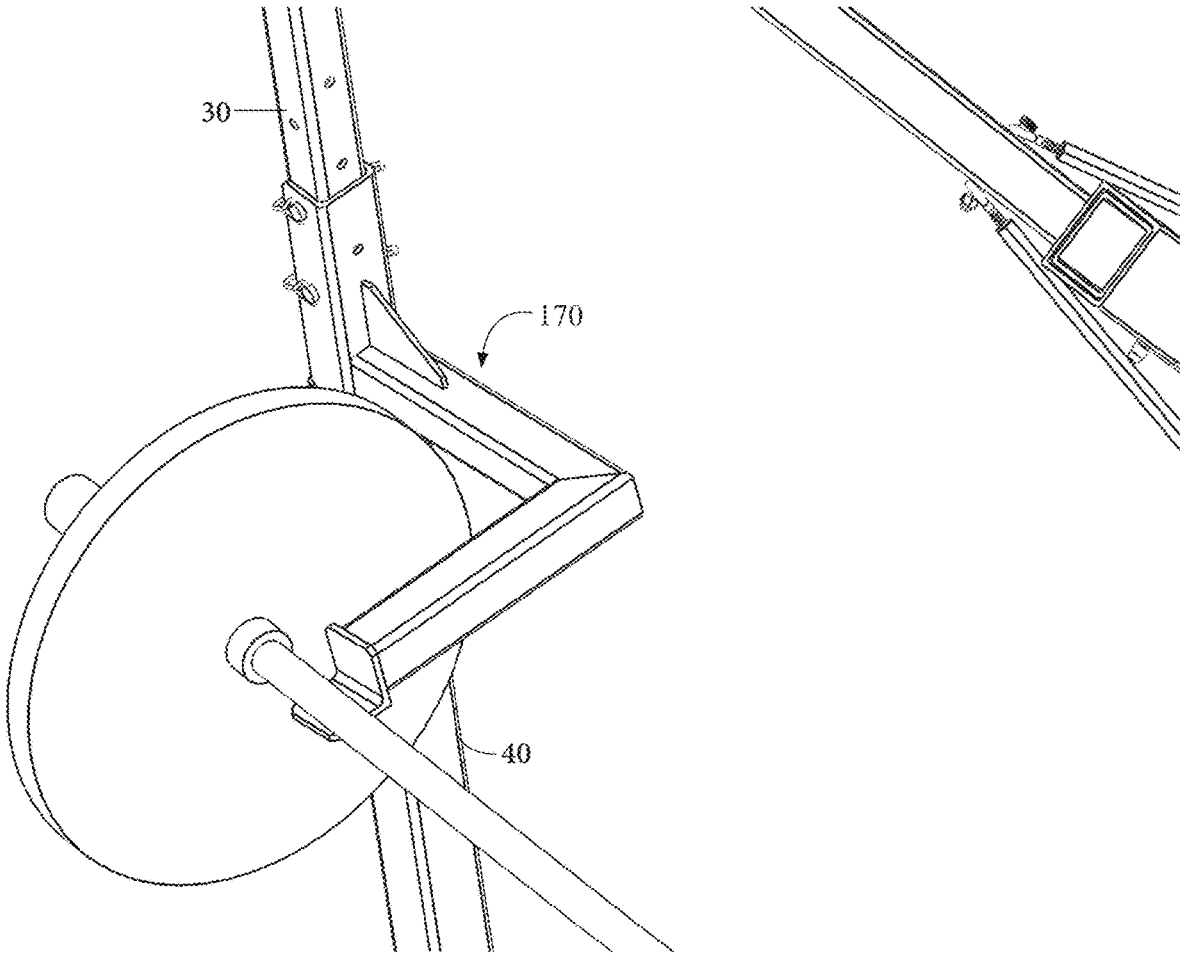
FIG. 11 is a close up partial perspective outward facing view of the embodiment shown in FIG. 3 showing the connection between the telescoping stabilization leg and the articulated squat arms for holding a barbell.
Figure 12:
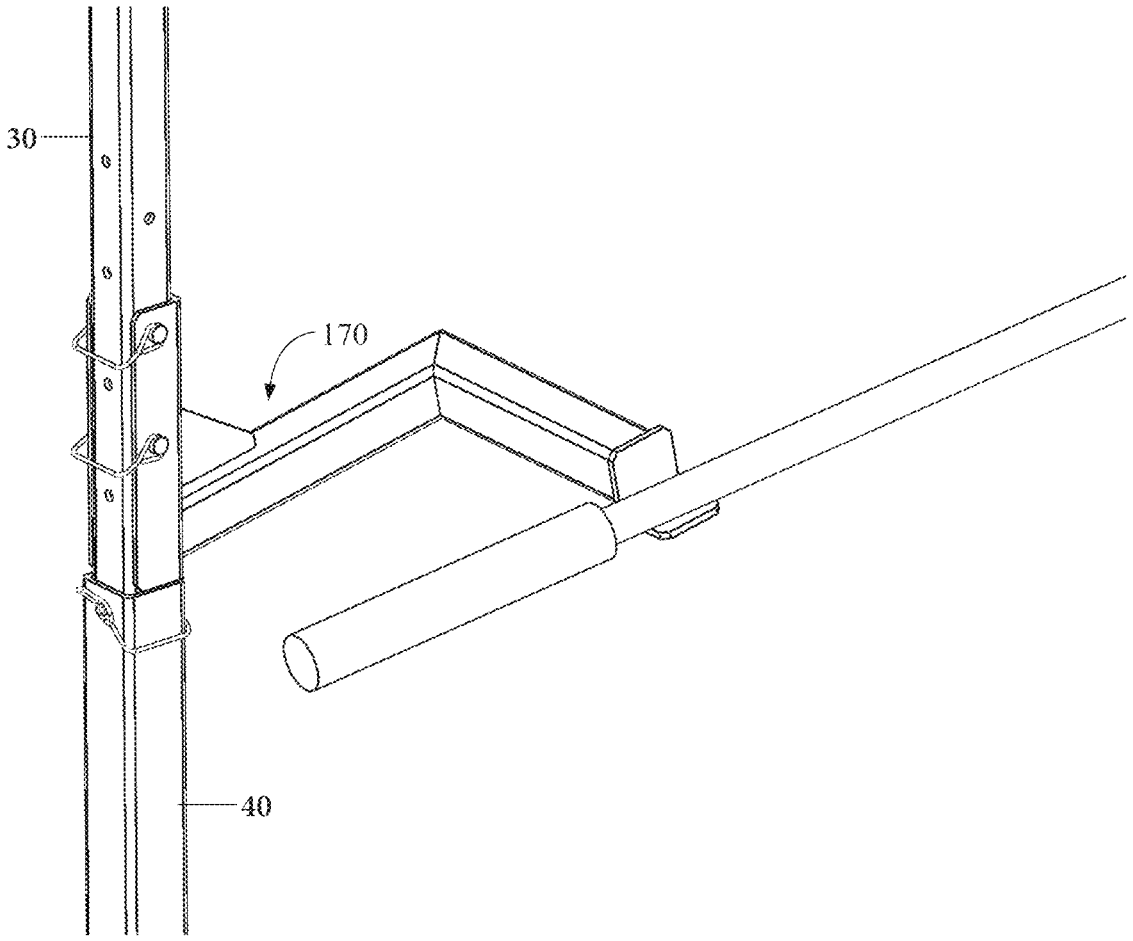
FIG. 12 is a close up partial perspective outward inward facing view of the embodiment shown in FIG. 3 showing the connection between the telescoping stabilization leg and the articulated squat arms for holding a barbell.

As shown in FIGS. 11 and 12 a pair of articulated squat arms 170 removably attach to telescopic stabilization leg 40 with locking mechanisms to enable users to perform different strength and power training exercises with the use of a barbell. Articulated squat arms 170 are configured to secure and hold the barbell in place when exercise apparatus 10 is not in use and extend inwardly from leg assemblies 35 to fit a standard-length barbell.

Figure 13:
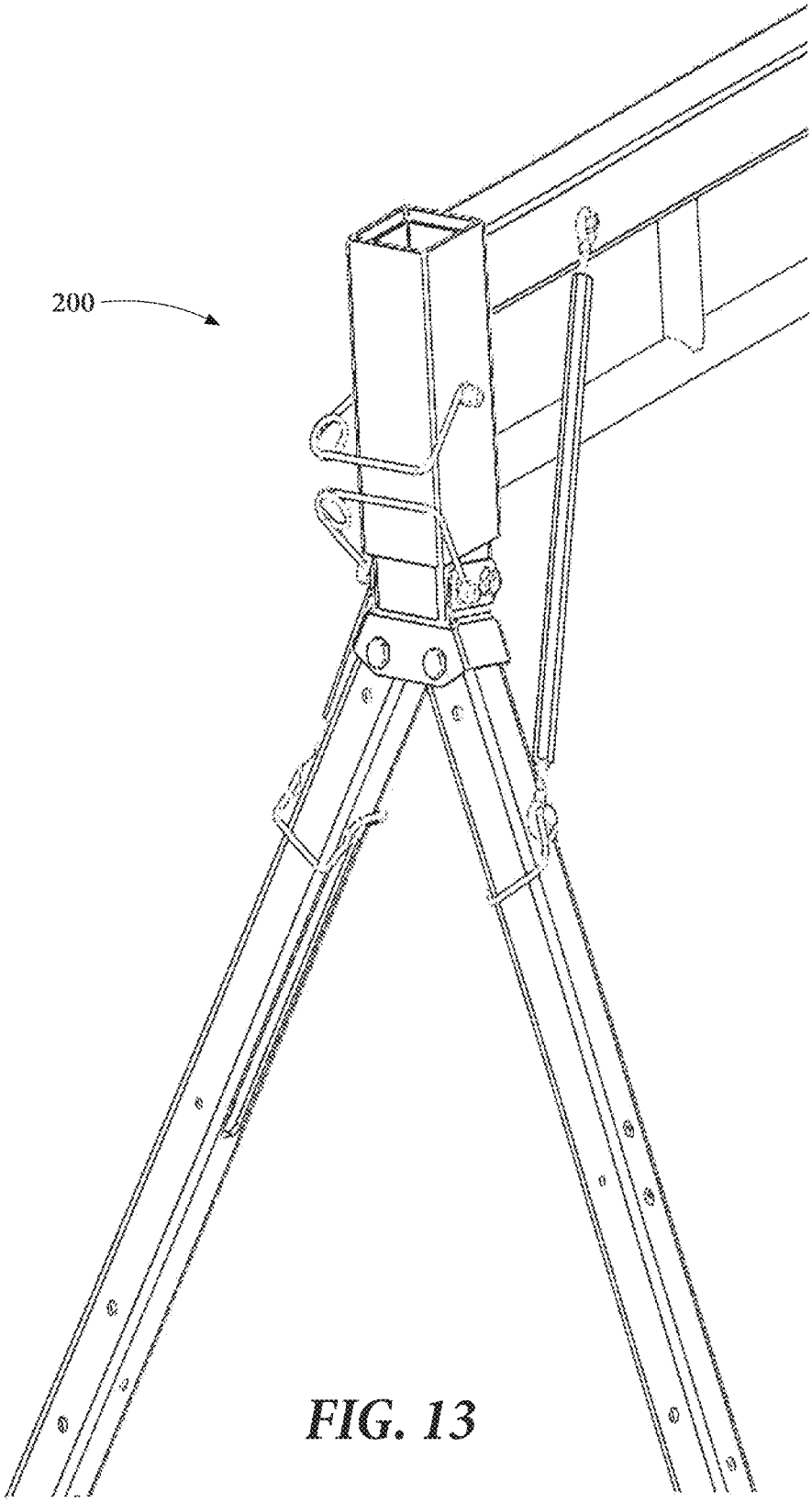
FIG. 13 is a close up partial perspective inward facing view of another embodiment of the present invention, showing the interconnection between the horizontal upper support structure, the insert, and the leg assembly.
Figure 13A:
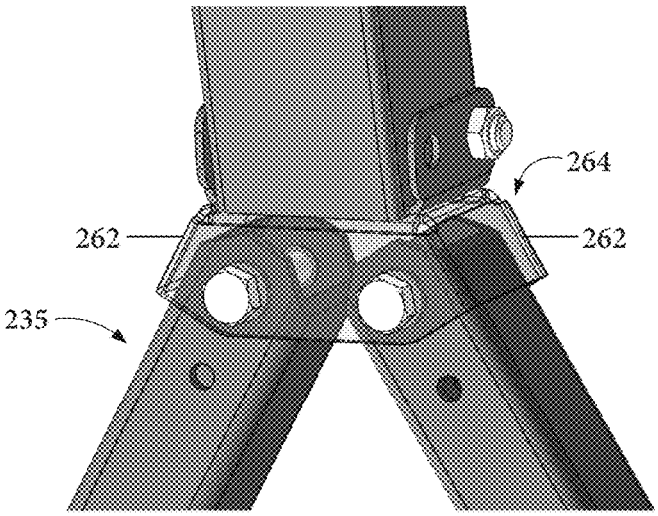
FIG. 13A is a close up partial perspective inward facing view of the embodiment shown in FIG. 13, in an unfolded position, showing the interconnection between the insert and the leg assembly.
Figure 13C:
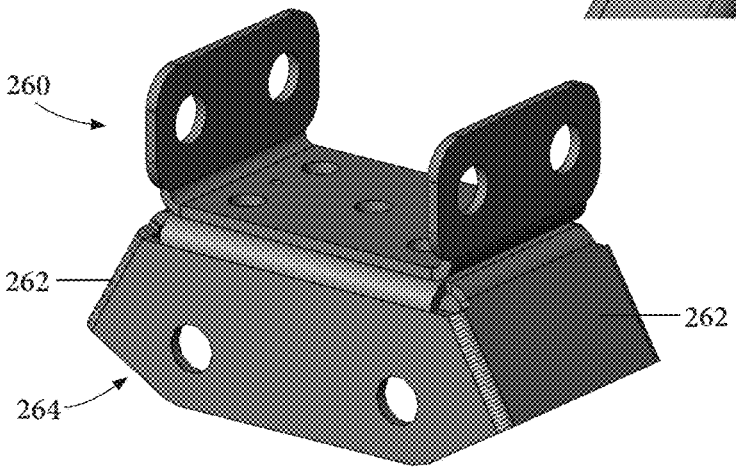
FIG. 13C is a perspective view of the joint hinge bracket of the embodiment shown in FIG. 13 in isolation.
Figure 13B:
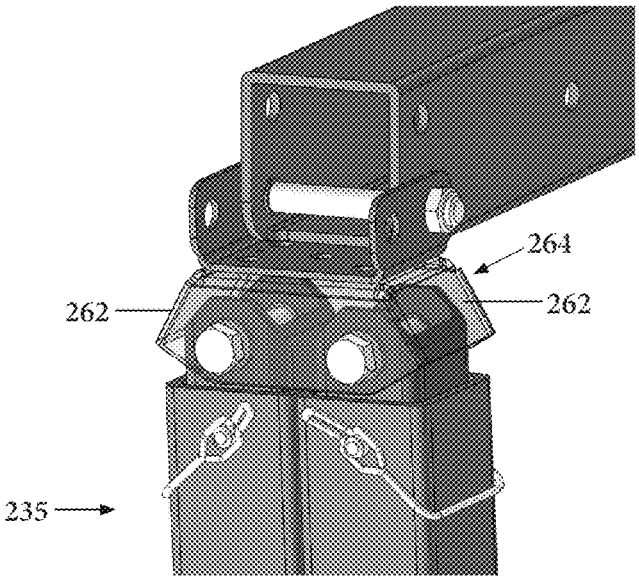
FIG. 13B is a close up partial perspective inward facing view of the embodiment shown in FIG. 13, in a folded position, showing the interconnection between the insert and the leg assembly.
Figure 13D:
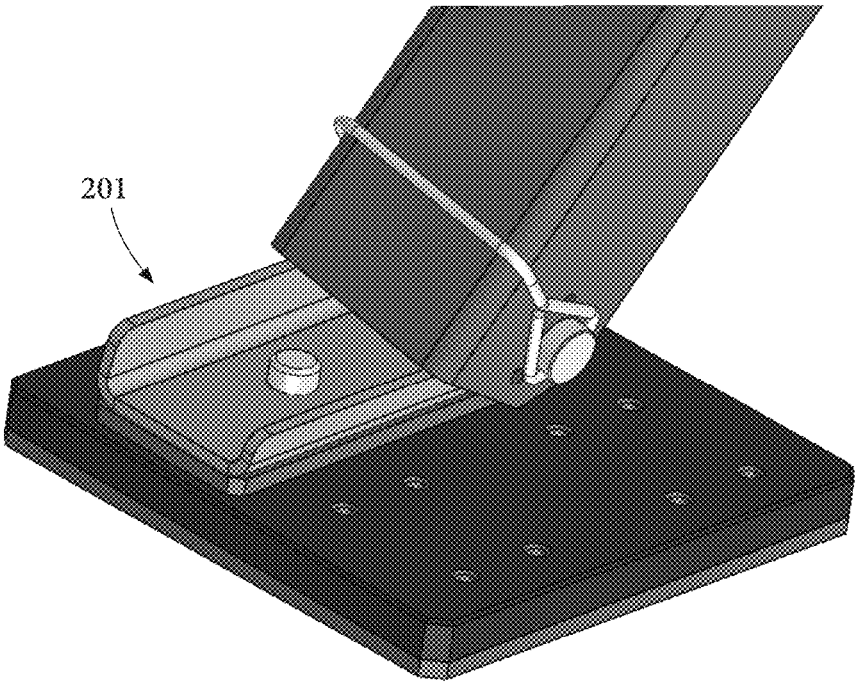
FIG. 13D is a close up partial perspective front view of the embodiment shown in FIG. 13 showing the connection between the retractable foot and the foot plate.
Figure 13E:
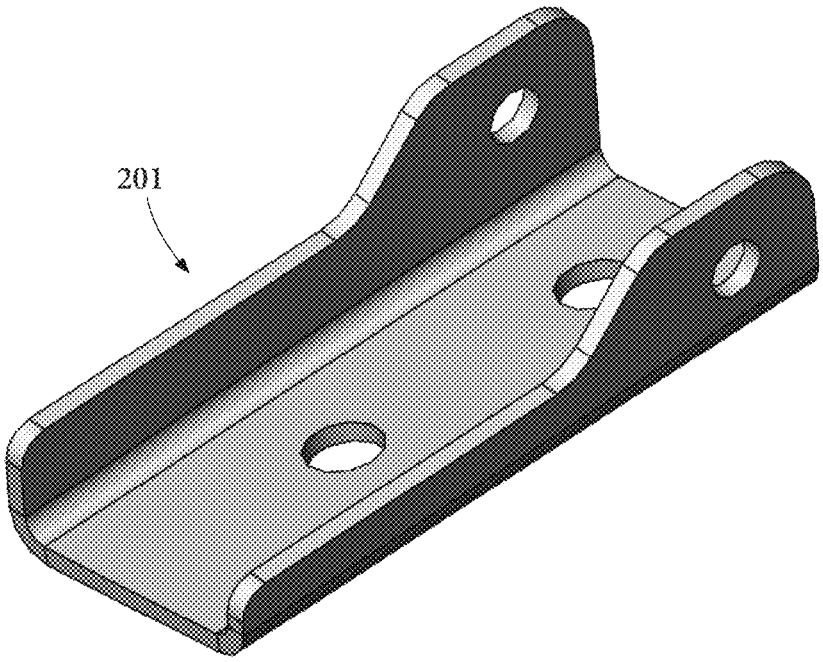
FIG. 13E is a perspective view of a retractable foot of the embodiment shown in FIG. 13 in isolation.

FIG. 13 shows an exercise apparatus 200 according to another embodiment. The functions and features of exercise apparatus 200 are similar to exercise apparatus 10. As best shown in FIG. 13A to 13C, exercise apparatus 200 has a lower bracket element 264 with angled sidewalls 262 that constrain maximum splay of the stabilization legs of leg assembly 235. As shown in FIGS. 13D and 13E, retractable foot 201 of exercise apparatus 200 is also of a simpler construction than retractable foot 100 of exercise apparatus 10.

It should be noted that any of the features, components, or details of any of the arrangements or embodiments disclosed in this application, including those disclosed below, are interchangeably combinable with any other features, components, or details of any of the arrangements or embodiments disclosed herein to form new arrangements and embodiments.

It is to be understood that this invention is not limited to those embodiments and modifications described in the specification. Modifications and variations can be made by one skilled in the fabrication, design and art without departing from the spirit and scope of the invention. Moreover, any of or more features of any embodiment of the invention may be combined with any one or more other features of any other embodiment of the invention, without departing from the scope of the invention.

For example, some embodiments may have leg assemblies that do not fold. With reference to FIG. 8, instead of a pivotable coupling between the insert and the joint hinge bracket, these two components may be fixedly coupled, or integrated, with the stabilization legs detachably coupled to the joint hinge bracket. Detachable coupling between the joint hinge bracket and the stabilization legs may for example be achieved by the joint hinge bracket including angled sleeves (for example in an upside down V shape) that receive the stabilization legs at angles that effect suitable splay of the stabilization legs for when the exercise apparatus is in use. The angled relationship between the joint hinge bracket and the insert may be maintained, providing the lateral splay of the leg assemblies as described herein. When the exercise apparatus is not in use, the stabilization legs may be detached from the lower bracket element, retracted, and strapped to the upper support structure/insert/joint hinge bracket.

For example, some embodiments may have 1, 2, 3, 4, 6, or more upper support structures without detracting from the invention. Some embodiments may have 1, 2, 3, 4, 6, or more stabilization legs that could be telescopic or non-telescopic and that may be made of metal, wood, plastic or rubber without detracting from the invention. Some embodiments may have removable and non-interconnected parts. Some embodiments may use bolts, pins, screws or other locking mechanisms to secure the parts. Some embodiments may use other methods of multi-directional stability and could have 0, 1, 2 or more parts without detracting from the invention.

As used in the description of this application, the terms "a", "an" and "the" may refer to one or more than one of an element (e.g., item or act). Similarly, a particular quantity of an element may be described or shown while the actual quantity of the element may differ. The terms "and" and "or" may be used in the conjunctive or disjunctive sense and will generally be understood to be equivalent to "and/or". Elements from an embodiment may be combined with elements of another. No element used in the description of this application should be construed as critical or essential to the invention unless explicitly described as such. Further, when an element is described as "connected," "coupled," "interconnected" or otherwise linked to another element, it may be directly linked to the other element, or intervening elements may be present.

While the description of this invention contains many specifications, these should not be construed as limitations on the scope of the invention, but rather as an exemplification of embodiments thereof.

The invention claimed is:

1. An exercise apparatus configurable in a collapsed configuration and an expanded configuration, the exercise apparatus comprising:

a horizontal upper support structure comprising a pair of vertical sleeves at opposing ends of the upper support structure;

first and second inserts receivable in a corresponding one of the vertical sleeves;

first and second leg assemblies coupled to a corresponding one of the first and second inserts;

wherein a bottom contact surface of each of the first and second inserts angles upwardly laterally outward, and wherein a top contact surface of each of the first and second leg assemblies is level, whereby when the exercise apparatus is in the expanded position respective top contact surfaces of the first and second leg assemblies abut corresponding bottom contact surfaces of the first and second inserts, whereby the first and second leg assemblies splay laterally outward.

2. The exercise apparatus according to claim 1 wherein each of the first and second inserts is engageable with a corresponding vertical sleeve at a retracted position, and at least the second insert is telescopically engageable with the corresponding vertical sleeve between the retracted position and an extended position;

wherein each of the first and second leg assemblies is pivotally coupleable to respective first and second inserts for pivotal adjustment between respective folded positions when the exercise apparatus is in the collapsed configuration and respective unfolded positions when the exercise apparatus is in the expanded configuration;

wherein in the collapsed configuration the first insert is engaged with the corresponding vertical sleeve at the retracted position, and the second insert is engaged with the corresponding vertical sleeve at the extended position, whereby the first leg assembly in the folded position is folded between the horizontal upper support structure and the second leg assembly in the folded position.

3. The exercise apparatus according to claim 2 wherein the vertical sleeves and the first and second inserts comprise corresponding locking means for releasably lockingly engaging the first and second inserts within the vertical sleeves in the retracted position, and releasably lockingly engaging the second insert in the extended position.

4. The exercise apparatus according to claim 3 wherein the locking means comprise a throughhole in each vertical sleeve, corresponding retracted position throughholes in the first and second inserts, and a corresponding extended position throughhole in the second insert, wherein the throughholes of the vertical sleeves and the first and second inserts are alignable to receive locking pins.

5. The exercise apparatus according to claim 4 wherein the first and second leg assemblies each comprise a joint hinge bracket for pivotally coupling to the first and second inserts, the joint hinge brackets each comprising a top bracket element and a bottom bracket element connected back-to-back and offset by 90 degrees.

6. The exercise apparatus according to claim 5 wherein the top bracket element comprises inner througholes and outer throughholes, each corresponding to inner throughholes and outer throughholes adjacent the bottom contact surfaces of the first and second inserts, wherein the first and second leg assemblies are pivotable when the inner throughholes of the top bracket element and first and second inserts are aligned and receive locking pins, but are not pivotable when the outer throughholes of the top bracket element and first and second inserts are aligned and receive locking pins or when both the inner and outer throughholes of the top bracket element and first and second inserts are aligned and receive locking pins.

7. The exercise apparatus according to claim 6 wherein an inner edge of the bottom contact surface of the first and second inserts is rounded equidistantly from the inner throughhole of the first and second inserts to facilitate pivotal motion of the first and second leg assemblies.

8. The exercise apparatus according to claim 7 wherein the first and second leg assemblies each comprise a pair of telescoping stabilization legs, wherein the bottom bracket element is fixedly connected to the telescoping stabilization legs.

9. The exercise apparatus according to claim 8 wherein each pair of the telescoping stabilization legs comprises a retractable foot.

10. The exercise apparatus according to claim 9 wherein a bottom surface of the retractable foot angles upwardly laterally inward in correspondence to the laterally outward splay of the first and second leg assemblies.

11. The exercise apparatus according to claim 10 wherein the bottom surface of the retractable foot angles upwardly laterally inward about 7.5 to 12.5 degrees, or about 10 degrees, from the horizontal.

12. The exercise apparatus according to claim 9 further comprising a foot plate attachment onto which the retractable foot is secured.

13. The exercise apparatus according to claim 12 further comprising a bar press attachment assembly comprising: a U-joint bracket fixed to the foot plate attachment; a U-joint block pivotally coupled to the U-joint bracket; and a bar press sleeve pivotally coupled to the U-joint block.

14. The exercise apparatus according to claim 8 wherein each pair of the telescoping stabilization legs comprises a foldable leg spread linking mechanism for reversibly locking the telescoping stabilization legs in a spread manner.

15. The exercise apparatus according to claim 8 wherein each pair of the telescoping stabilization legs comprises a retractable locking leg bracket.

16. The exercise apparatus according to claim 8 further comprising a pair of articulated squat arms releasably lockingly coupled to the one of each pair of the telescoping stabilization legs.

17. The exercise apparatus according to claim 8 wherein one of each pair of the telescoping stabilization legs comprises a throughhole at a lower portion thereof for receiving a pin for receiving weight plates for storage and stability of the exercise apparatus.

18. The exercise apparatus according to claim 1 wherein the corresponding bottom contact surfaces of the first and second inserts angles upwardly laterally outward at about 2.5 to 7.5 degrees, or about 5 degrees, from the horizontal.

* * * * *